US006772449B1

(12) United States Patent
Wolfe

(10) Patent No.: US 6,772,449 B1
(45) Date of Patent: Aug. 10, 2004

(54) TOILET VENTILATION SYSTEM

(76) Inventor: John P. Wolfe, 5457 E. Capri Ave., Mesa, AZ (US) 85206

( * ) Notice: Subject to any disclaimer, the term of this patent is extended or adjusted under 35 U.S.C. 154(b) by 0 days.

(21) Appl. No.: 10/638,628

(22) Filed: Aug. 11, 2003

(51) Int. Cl.[7] ..... A47K 13/00; E03D 9/04
(52) U.S. Cl. ..... 4/217; 4/213; 4/347
(58) Field of Search ..... 4/209 R–219, 4/347

(56) References Cited

U.S. PATENT DOCUMENTS

| | | | | |
|---|---|---|---|---|
| 1,861,501 A | | 6/1932 | Lowther | |
| 3,108,289 A | | 10/1963 | Smith | |
| 3,277,499 A | | 10/1966 | Keefauver | |
| 3,733,619 A | | 5/1973 | Smith | |
| 3,849,803 A | | 11/1974 | Olson et al. | |
| 4,125,906 A | | 11/1978 | Weiland | |
| 4,222,129 A | | 9/1980 | Baker | |
| 4,375,704 A | | 3/1983 | Smith | |
| 4,620,329 A | | 11/1986 | Wix | |
| 4,780,913 A | | 11/1988 | Williams | |
| 5,010,600 A | * | 4/1991 | Prisco | 4/217 |
| 5,016,294 A | | 5/1991 | Canovas | |
| 5,199,111 A | | 4/1993 | Antepenko | |
| 5,355,536 A | | 10/1994 | Prisco | |
| 5,724,682 A | * | 3/1998 | Johnson | 4/217 |
| 5,991,934 A | | 11/1999 | Hsu | |
| 5,996,131 A | | 12/1999 | Vallair | |
| 6,052,837 A | | 4/2000 | Norton et al. | |
| 6,055,677 A | | 5/2000 | McKinley | |
| 6,167,576 B1 | * | 1/2001 | Sollami | 4/217 |
| 6,360,377 B2 | | 3/2002 | Sollami | |
| 6,457,186 B1 | | 10/2002 | Stewart | |
| 6,463,595 B2 | | 10/2002 | Prisco et al. | |
| 6,496,986 B1 | | 12/2002 | Lumsden | |
| 6,499,150 B1 | | 12/2002 | Thompson | |
| 6,523,184 B2 | | 2/2003 | Prisco | |
| 6,553,581 B1 | * | 4/2003 | Lee | 4/217 |

* cited by examiner

*Primary Examiner*—Gregory L. Huson
*Assistant Examiner*—Khoa Huynh

(57) ABSTRACT

A toilet seat ventilation assembly for mounting on a toilet bowl includes a seat having a and air passageway and plurality of vent holes formed in the seat. A tubular manifold is rotatably secured in mounting fixtures at the rear of the toilet seat. The toilet seat is rotatably secured to the manifold by hinges having a passageway for communicating air from the toilet seat to the inlet of the manifold. The mounting fixtures have a passageway for communicating air from the outlet of the manifold to an exhaust conduit. The toilet seat cover has hinges for connecting the toilet seat cover to the manifold in a fixed manner. Pivoting the toilet cover between a horizontal position and a vertical position causes the manifold to rotate within the toilet seat hinges and the mounting fixtures. The inlets and outlets of the manifold are configured so that air from around the toilet bowl is communicated into and out of the manifold to an external vent when the toilet cover is in the vertical position and the toilet seat is in a horizontal position.

16 Claims, 9 Drawing Sheets

TOILET VENTILATION SYSTEM

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to a ventilation system for removing odor-filled air from around the toilet and transporting the air to an external vent. The ventilation includes a modified toilet seat which is mounted on the toilet bowl for communication with a tubular manifold at the rear of the toilet seat. The manifold is rotated to align inlets for air passage from the toilet seat into the manifold and to align outlets for communicating the air through hollow mounting fixtures to a conduit and an external vent.

BACKGROUND OF THE INVENTION

Foul odors around indoor toilets have been a problem for as long as people have had indoor plumbing. Ventilation fans have been installed in the ceilings of bathrooms, but such fans are often ineffective in removing the odor. Over the years, numerous ventilation systems have been designed which mount on or adjacent to the toilet. But such ventilation systems are often difficult to mount and install. In addition, bulky components are often visible to a person using the toilet, which detracts from the overall appearance of the bathroom.

U.S. Pat. No. 4,125,906 discloses a toilet venting apparatus having a conduit which extends around and through the toilet seat. Two ports are provided about the hinges to facilitate withdrawal of the air from around the toilet seat. U.S. Pat. No. 6,463,595 discloses a fixed manifold positioned at the rear of the toilet seat. An elbow fitting is connected to a vent conduit. A fan motor is used to draw air from the toilet seat area through the elbow and conduit to an external vent. U.S. Pat. No. 6,055,677 also shows a fixed exhaust cavity located at the rear of the toilet seat. When the seat is down, slots in the toilet seat are aligned with slots in the fixed cavity. Pivoting the toilet seat to a vertical position causes the seat to block the slots in the cavity. U.S. Pat. No. 4,620,329 provides for a toilet seat having an internal channel. Air is conveyed through the hinge mechanism to the seat through a conduit to an exhaust fan.

Other patents related to ventilation systems and ventilated toilet seat assemblies include U.S. Pat. Nos. 6,523,184; 6,499,150; 6,496,986; 6,457,186; 6,360,377; 6,052,837; 5,996,131; 5,991,934; 5,355,536; 5,199,111; 5,016,294; 4,780,913; 4,375,704; 4,222,129; 3,849,808; 3,733,619; 3,277,499; 3,108,289; and 1,861,501.

Most of the prior art toilet ventilation systems disclosed in the patents have the major disadvantage or drawback of not being adapted for easy mounting and use with conventional toilets. Many of the patented prior art systems require filters or other special components mounted on the toilet bowl. Another disadvantage of prior art systems is their technical complexity and relatively high cost. Some of the prior art designs are not compatible with the variety of existing toilet configurations and designs.

Another problem is that many of the systems fail to meet applicable building codes or regulations. One particular problem is that when ventilating in the area of the toilet, it is desirable to draw air from very close to the toilet. In many arrangements, however, the configuration of the system would allow liquid to be drawn into the system. Such a configuration is dangerous and in many cases would be a code violation.

In general, none of the existing ventilation systems for removing odors directly at the toilet have been commercially successful. There is still a need for a toilet ventilation system that is easily connectable to the toilet bowl. It would also be beneficial to have a ventilation system that has a similar appearance to a standard toilet seat and toilet bowl. Another benefit would be to have a ventilation system for a toilet bowl that automatically and temporarily operates when someone is sitting on the toilet seat.

SUMMARY OF THE INVENTION

The present invention for a toilet ventilation system is configured for mounting in the standard mounting holes on a toilet bowl. The system includes as a toilet seat assembly having a special toilet seat and seat cover. A passageway is established from vent holes in the toilet seat through a passageway in the seat hinges to inlets on a tubular manifold secured at the rear of the toilet seat. The manifold includes one or two outlets such that air drawn from the area of the toilet bowl is communicated from the outlet of the manifold through a passageway in the mounting fixture.

In addition to these components of the toilet seat assembly, a conduit is used to communicate the air to an external vent. A fan motor or other ventilation means for moving air is typically connected to the conduit in a remove location from the toilet bowl. The preferred mounting location for the motor is in a position much higher than the toilet bowl to minimize the risk of water being drawn into the system to damage the motor. The external vent may be positioned in the roof or outside wall of a home or other building similar to other ventilation systems.

The toilet seat assembly is easy to mount on a toilet bowl. The distance between the mounting holes is the same distance on the most common residential toilet bowls. Except for the shape of the seat and seat cover, the components of the assembly would be the same for all toilet bowls. The toilet seat ventilation assembly, conduit, fan motor, and control switches could be furnished as original equipment on toilet bowls or be sold as a kit for the replacement aftermarket. The toilet seat and seat cover dimensions are also somewhat standardized so that a few toilet seat and seat cover designs would cover most of the existing toilet bowl designs.

The toilet ventilation system of the present invention utilizes special hinges and mounting fixtures to facilitate communication of the air from the toilet bowl to an external vent. These components are used not only for standard functional purposes, such as securing the seat to the toilet bowl and raising and lowering the toilet seat, they are also designed to provide a passageway for communication of air. But since the external appearance is similar to a standard assembly, the appearance of the toilet seat is not significantly altered. The small tubular manifold at the back of the toilet seat and the conduit extending from the back of the toilet bowl are the only readily apparent changes from a standard toilet seat.

The toilet seat ventilation assembly at the back of the toilet seat includes a hollow tubular manifold. The mounting fixture, toilet seat hinge, and seat cover hinge located at each end of the manifold include a mounting ring for accepting the manifold. In the preferred embodiment, the manifold is permanently affixed only to the cover hinge. When the seat cover is raised or lowered, the movement of the seat cover causes the manifold to rotate within the mounting rings of the seat hinge and the mounting fixtures. The mounting fixtures are fixed to the toilet bowl and the only moving action for the mounting fixture is the rotation of the manifold in the mounting ring. For the toilet seat hinge, the manifold may rotate in the mounting ring of the seat hinge when the toilet seat cover is moved. In addition the seat hinge may be rotated about the manifold when the seat itself is raised or lowered.

The manifold has at least one and preferably two aperture inlets, one under each of the mounting ring of the seat hinge. The manifold has at least one and preferably two aperture outlets, one under each of the mounting rings of the mounting fixture. The passageways for the seat hinge and the mounting fixture each extend to the mounting ring of their respective component. When the passageway of the seat hinge is aligned with the inlet aperture of the manifold, air enters the manifold from the seat area. When the passageway of the mounting fixture is aligned with the outlet, air is withdrawn from the manifold. The inlets and the outlets are formed in the surface of the manifold near the end of the manifold. The selective rotation of the manifold in the mounting rings by raising and lowering the cover, and the selective rotation of the seat hinge about the manifold, will cause the passageways either to be blocked by the sides of the manifold, or to be aligned with the inlet or outlet apertures to facilitate communication with the interior of the manifold. This is especially useful when multiple toilets are manifolded together using a common exhaust fan motor.

The toilet seat and the cover may be positioned in three different combinations: both down, both up, and toilet seat down with cover up. When both the cover and the toilet seat are up, the manifold blocks the passageways and air is not communicated through the manifold. When the cover is up and the seat is down, the inlets and outlets are aligned with the passageways such that air is communicated through the manifold. When both the cover and the seat are down, the inlets and outlets of the manifold block the passageways. The motor of the fan or other air movement device for the toilet ventilation system may be operated by an on-off switch positioned in proximity to the toilet, by a pressure sensitive switch mounted under the toilet seat, or by some other control means.

The present invention provides a toilet ventilation system that is easy to install and operate. The present invention also has an appearance somewhat similar to a standard toilet seat and mounting assembly.

DETAILED DESCRIPTION OF THE PREFERRED EMBODIMENTS

Figure 1:
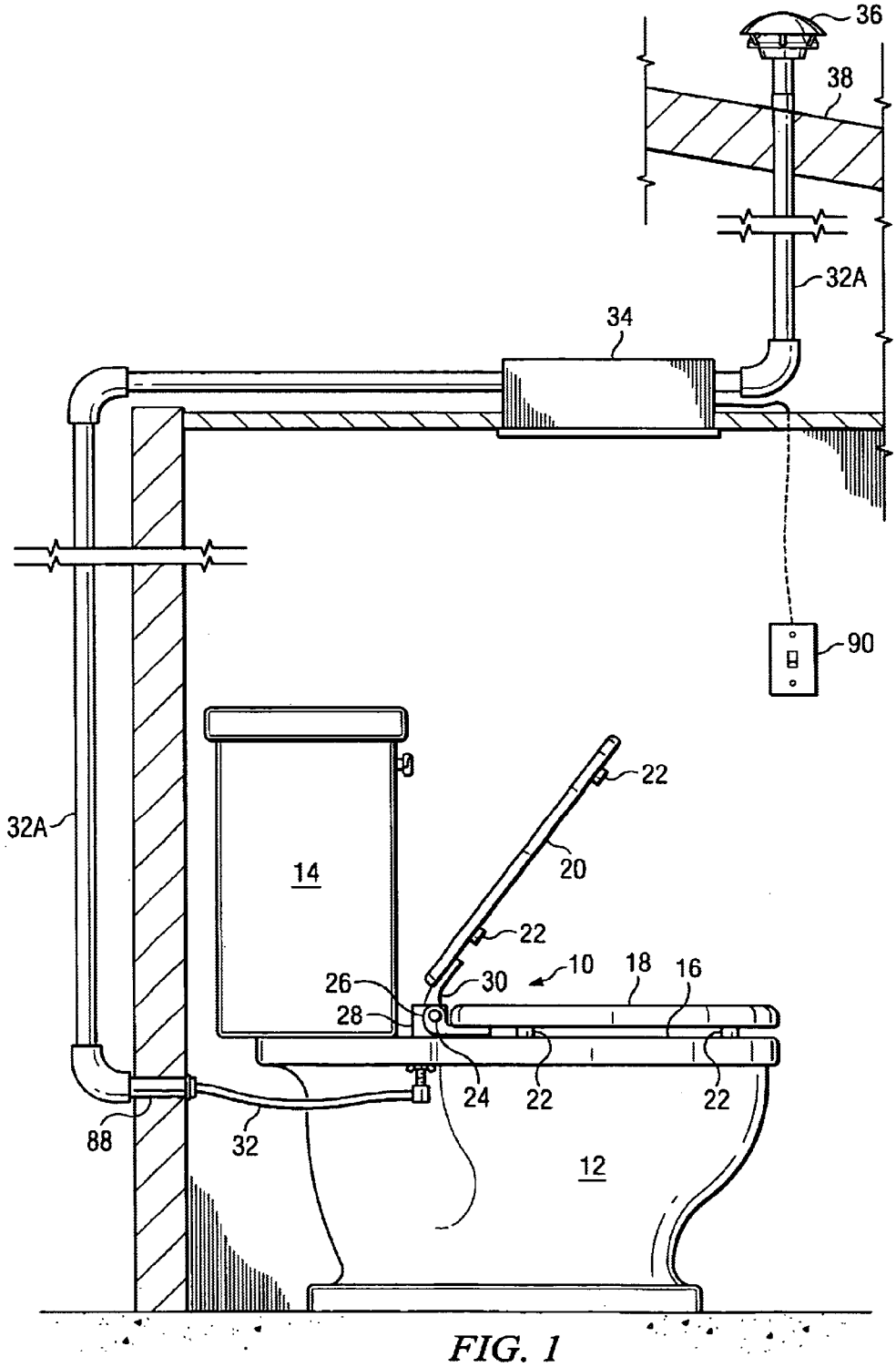
FIG. 1 is a side view of a toilet bowl in a typical bathroom showing the positioning of the ventilation assembly at the rear of the toilet bowl and the conduit used to transport air from the toilet bowl to an external vent.
Figure 2:
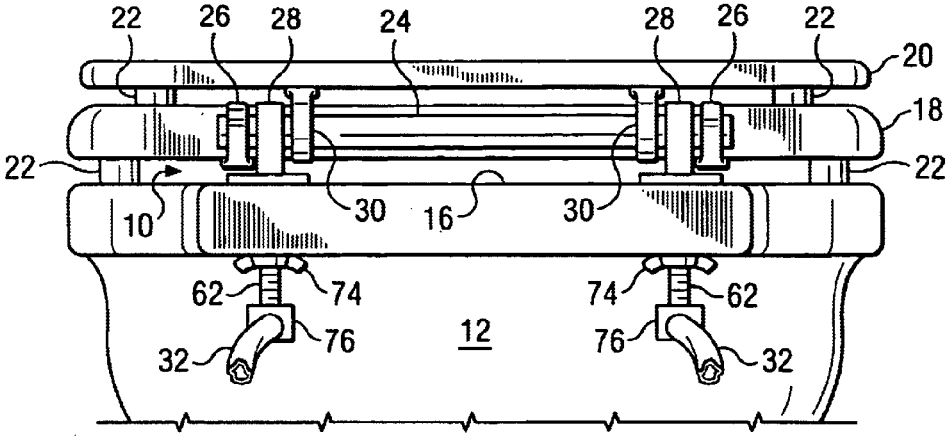
FIG. 2 is a rear elevational view of the toilet bowl ventilation assembly positioned on the upper surface of the toilet bowl.

Referring now to FIGS. 1–2, the toilet seat ventilation assembly 10 of the present invention is shown mounted on a toilet bowl 12. The toilet bowl 12 includes a water tank 14 positioned above and towards the rear of the toilet bowl in conventional construction. The top surface 16 of the toilet bowl 12 forms an opening, and such opening may be generally circular, oval, or other similar shape. The toilet seat 18 and the seat cover 20 can be of any shape to which matches the general configuration of the opening in the toilet bowl 12. Padded spacers 22 are secured to the bottom of the seat 18 to support the seat 18 in a horizontal position on the top surface 16 and to prevent the hard seat 18 from damaging the porcelain toilet bowl 12. Padded spacers 22 are also mounted on the bottom of the toilet seat cover 20. The construction and operation of the toilet bowl 12 and water tank 14 are well known and will not be described herein.

The toilet seat ventilation assembly 10 includes a tubular manifold 24, seat hinges 26, mounting brackets 28 and cover hinges 30. All of these components are positioned at the rear of the toilet seat 18. The mounting brackets 28 include a hollow, externally threaded mounting bolt 62 extending from the body of the mounting bracket trough the rim of the toilet bowl 12. A wing nut 74 is tightened on the mounting bolt 62 to secure the mounting bracket 28 to the toilet bowl 12. The ventilation system includes a conduit 32 extending from the discharge fixture 76 at the end of the mounting bolt 62 of the mounting bracket 28 to a motor driven electrical device 34 for moving air in the system. The device 34 may be a vacuum fan, a vacuum pump, or other similar means for moving air through the conduit 32. The motor device 34 moves air from the toilet seat 18 through the conduit 32 to an external vent 36 on the house 38 or other building on which the system is provided.

Figure 3:
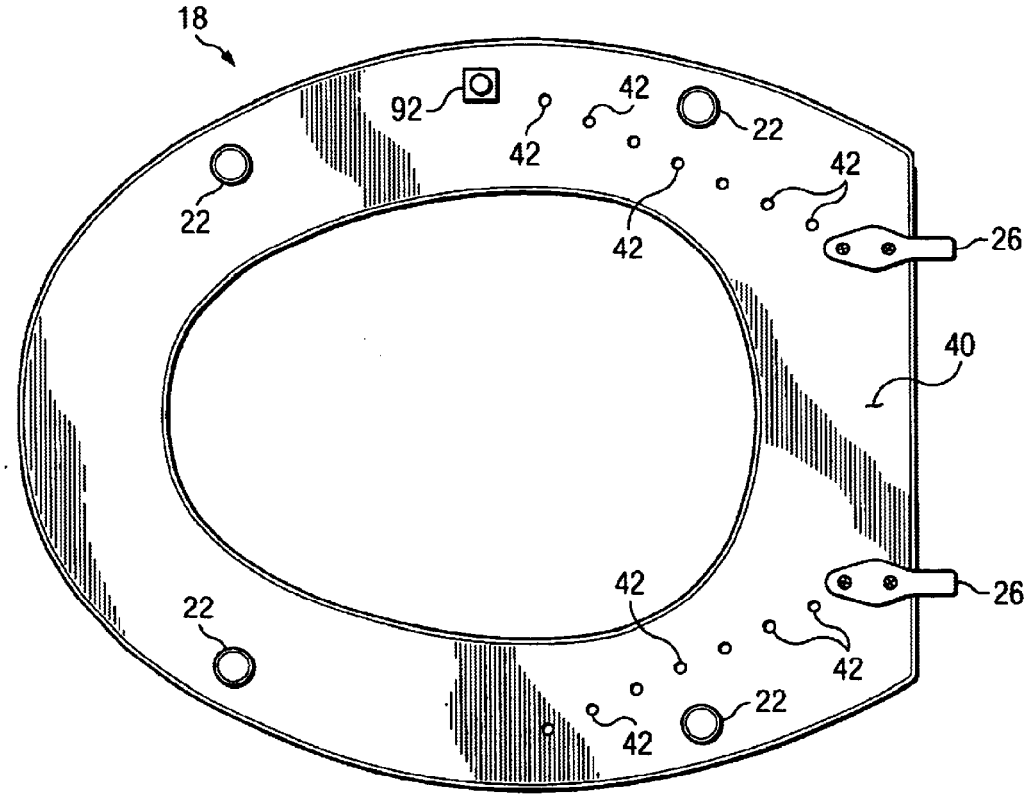
FIG. 3 is a bottom plan view of the toilet seat and the seat hinges.

The ventilation assembly 10 is useful with a variety of toilet seats. Preferably, the assembly 10 is used with a specially configured toilet seat 18 as shown in FIG. 3. The seat 18 may be of a variety of shapes and sizes. The seat 18 has the form of an elongated closed ring defining a central opening. The seat 18 need not form a closed ring but may be of the open-front type commonly found in public restrooms. The toilet seat 18 has a bottom surface 40 with at least one vent 42 located in the bottom surface 40. Typically multiple vents 42 may be formed in the bottom surface 40 along both sides of the toilet seat 18. The vents 42 may be of any shape and size. Elongated oval vents as well as small circular vents are known in the prior art. The circular vents 42 are easier to form from a manufacturing standpoint and provide adequate ventilation capabilities.

An internal passageway 44 is formed in the seat 18 and is in communication with a discharge aperture 46 in the back edge of the toilet seat 18. The seat 18 only requires a single discharge aperture 46, but typically the seat 18 will have passageways 44 on both sides of the seat 18 with two discharge apertures 46, one on each side of the seat 18. The seat 18 can be formed using different procedures. In a one piece seat, the passageways 44 could be drilled from the rear edge of the seat 18. The vents 42 could then be drilled from the bottom surface 40 of the seat 18, making sure that the vents 42 were in communication with the passageways 44. The seat 18 could also be formed by connecting a top piece and a bottom piece together. The passageways 44 could be formed by a recessed area in the top surface of the bottom piece or the bottom surface of the top piece. When the two pieces are connected together, the enclosed passageway 44 is formed. The vents 42 are drilled in the bottom piece to be in communication with the passageway 44. The discharge apertures 46 are formed at the back edge of the toilet seat 18. The discharge apertures 46 may be of any shape, with circular being the preferred shape. The seat 18 and the seat cover 20 may be constructed from a wide variety of materials, including any of the materials commercially available for conventional toilet seats and covers.

Figure 4:
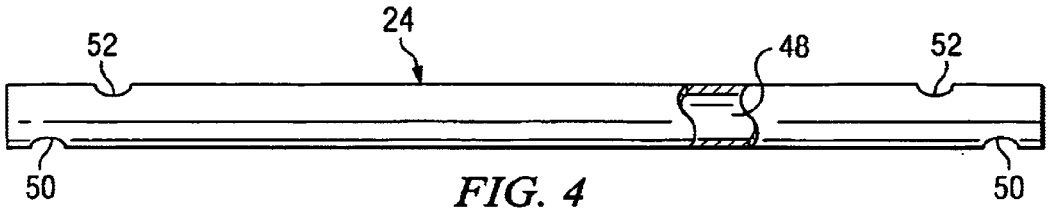
FIG. 4 is front view of the tubular manifold showing the inlet and outlet apertures in the surface of the manifold at each end of the manifold.
Figure 4A:
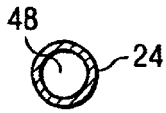
FIG. 4A shows a cross-sectional view of the manifold.

As shown in FIGS. 4–4A, the tubular manifold 24 has a circular configuration and is sealed or capped at both ends to provide an enclosed manifold cavity 48. The manifold 24 is operable with a single inlet 50 and a single outlet 52 formed in the surface of the manifold. But the preferred configuration is to provide an inlet 50 and an outlet 52 at both ends of the manifold 24 for communication between the inlets 50 and the respective seat hinges 26, and between the outlets 52 and the respective mounting brackets 28. The inlet 50 and outlet 52 are spaced apart and may be circular or oval in shape. The inlet 50 and outlet 52 are not aligned on the outer surface of the manifold 24; they are longitudinally offset based on the mounting configuration of the seat hinges 26 and the mounting brackets 28. Air which enters the manifold cavity 48 through an inlet 50 may be drawn from the cavity 48 from either of the outlets 52.

Figure 5:
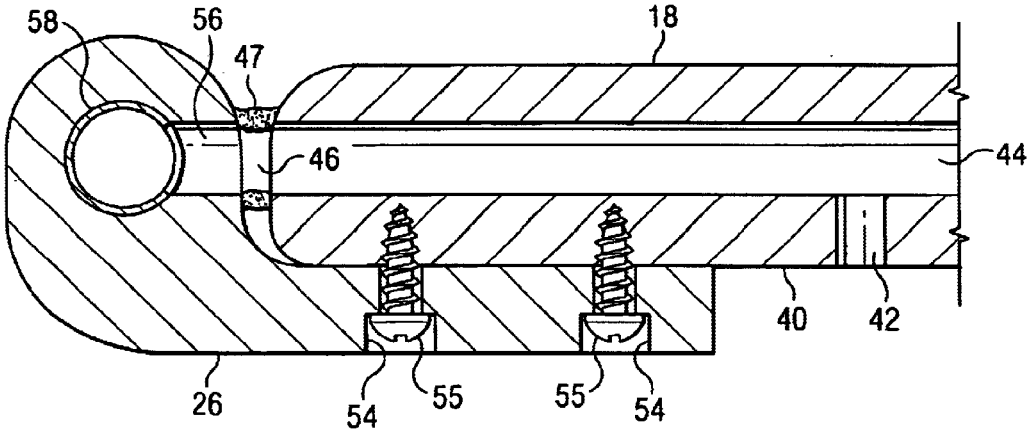
FIG. 5 is an enlarged, cross-sectional view of a toilet seat hinge.

FIG. 5 shows a toilet seat hinge 26 having screw holes 54 for accepting screws 55 used to secure the toilet seat hinge 26 to the bottom surface 40 of the seat 18. The hinges are typically made from molded plastic or other similar material known for use in seat hinges. The seat hinge 26 includes a passageway 56 for communicating air from the discharge aperture 46 of the seat 18 to the inlet 50 of the manifold 24. A mounting ring 58 for is also formed in the hinge 26, the mounting ring 58 being used to position the hinge 26 on the manifold 24. The inner diameter of the mounting ring 58 and the outer diameter of the tubular manifold 24 are sized so that the fit is tight enough to prevent significant amounts of air from leaking at the junction of the passageway 56 and the manifold 24. However, the arrangement still permits the manifold 24 to be rotated in the mounting ring 58, and similarly permits the mounting ring 58 to be rotated about the manifold 24.

Figure 6:
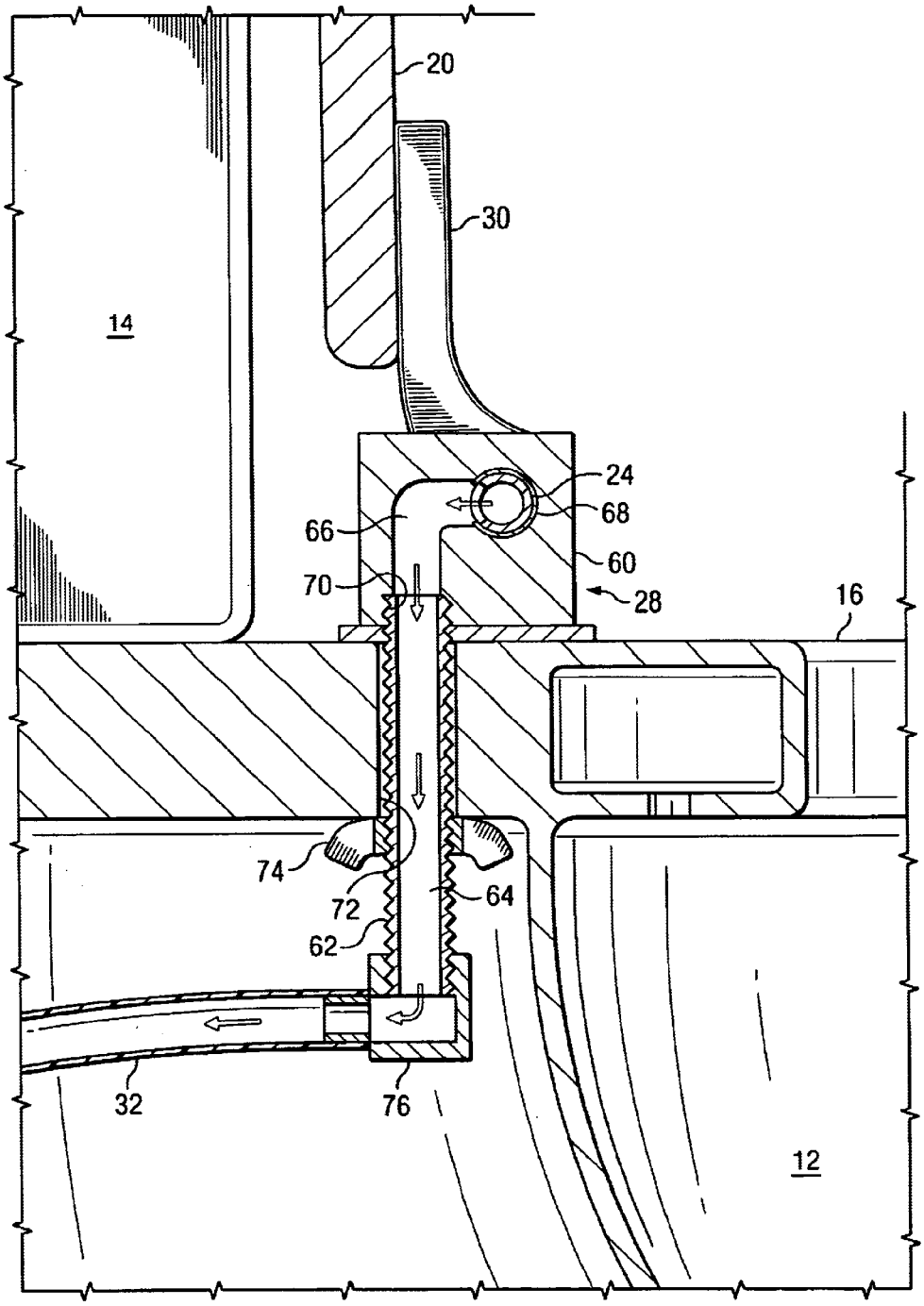
FIG. 6 is an enlarged, cross-sectional view of a mounting fixture positioned on the top surface of the toilet bowl with the toilet seat cover in a raised, vertical position and with toilet seat and seat hinge removed, the mounting fixture securing the toilet seat ventilation assembly to the toilet bowl and rotatably securing the manifold at the rear of the toilet seat.

FIG. 6 shows a mounting bracket 28 having an externally threaded bolt 62 extending from the bottom of the body 60 of the mounting bracket 28. The bolt 62 is made from metal or other acceptable material. The bolt 62 is hollow, which provides a passageway 64 from one end of the bolt 62 to the other. The body 60 of the mounting bracket 28 includes an internal passageway 66 which extends from a mounting ring 68 through the body 60 to the bottom surface of the body 60. The bottom segment 70 of the passageway 66 is threaded to permit the externally threaded bolt 62 to be secured in the passageway 66. The manifold 24 is rotatably positioned within the mounting ring 68. The inner diameter of the mounting ring 68 and the outer diameter of the tubular manifold 24 are sized so that the fit is tight enough to prevent significant amounts of air from leaking at the junction of the passageway 66 and the manifold 24. However, the arrangement still permits the manifold 24 to be rotated in the mounting ring 68.

The mounting brackets 28 are used to secure the manifold 24, seat 18 and the cover 20 to the toilet bowl 12. The externally thread bolts 62 are passed through the standard mounting apertures 72 of the toilet bowl 12 such that the body 60 of the mounting bracket is secured to the top surface 16 of the toilet bowl 12. A wing nut 74 or other form of nut is secured to the free end of the bolt 62 to tighten the mounting bracket 28 into a fixed position. A washer (not shown) may be provided between the nut 74 and the toilet bowl 12 for distributing the applied force to prevent chipping or cracking of the toilet bowl 12. A discharge fixture 76 is secured to the end of the bolt 62 to facilitate connection of the conduit 32 to the system 10. A clamp (not shown) may be used to secure the conduit 32 to the discharge fixture 76

One advantage of the present invention is that a single pair of mounting brackets 28 with bolts 62 can be used to mount the entire assembly 10, including the seat 18 and cover 20. The standard, original equipment mounting apertures 72 are used. In order to install the assembly 10 of the present invention, the only steps typically required are to unloosen the fasteners and remove the existing toilet seat mounting assembly, and then to insert the mounting bolts 62 through the mounting apertures 72 of the toilet bowl 12 and tighten the nuts 74 of the ventilation assembly 10 of the present invention.

Figure 7:
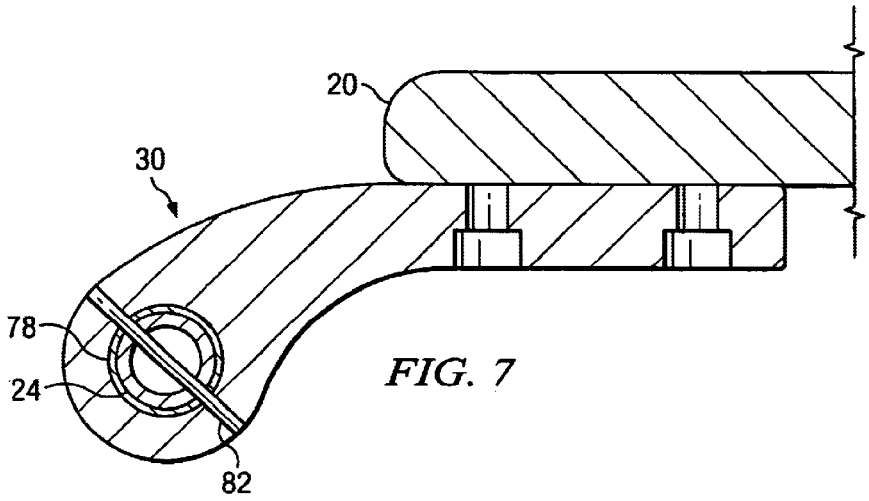
FIG. 7 is an enlarged, fragmental, cross-sectional view of the toilet seat cover hinge secured about the tubular manifold.

The seat cover 20 includes a hinge 30 having a mounting ring 78 for positioning the hinge 30 on the manifold 24, as shown in FIG. 7. The cover 20 is secured to the hinges 30 by screws (not shown) positioned in screw holes 80 of the hinges 30. A pin 82 or other fastening means is used to secure the hinge 30 to the manifold 24.

The tubular manifold 24 is positioned along the back edge of the toilet seat 18 and extends through three mounting rings 58, 68, 78 at each end. The manifold is secured to the cover hinge mounting ring 78 such that raising and lowering the cover 20 causes the manifold to rotate in the mounting rings 58 of the seat hinge 26 and the mounting rings 78 of the mounting brackets 28. The mounting brackets 28 are secured to the toilet bowl 28 so there is no additional movement affecting the mounting rings 68 and the manifold 24. The toilet seat 18 may be raised and lowered, in which case the mounting ring 58 of the toilet seat hinge 26 rotates about the manifold 24. The cover hinge mounting ring 78 is typically positioned on the inside of the three mounting rings. The position of the mounting bracket 28 and the seat hinge 26 on the manifold 24 are interchangeable, provided that the inlet 50 is positioned in the seat hinge mounting ring 58 and outlet 52 is positioned in the mounting bracket mounting ring 68.

Figure 8A:
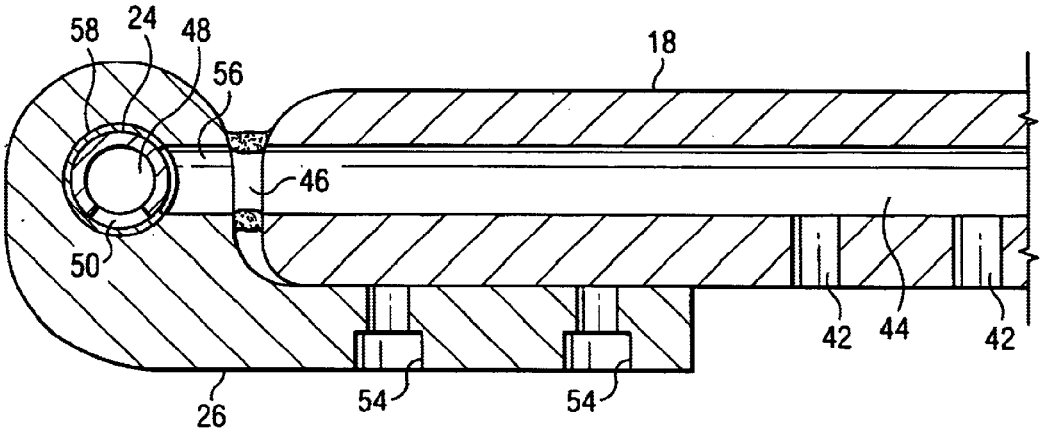
FIG. 8A is a cross-sectional view of the toilet seat hinge and tubular manifold and FIG. 8B is a cross-sectional view of the mounting fixture and tubular manifold when the seat and cover are both in a horizontal, lowered position and air is not being ventilated from the toilet bowl.
Figure 8B:
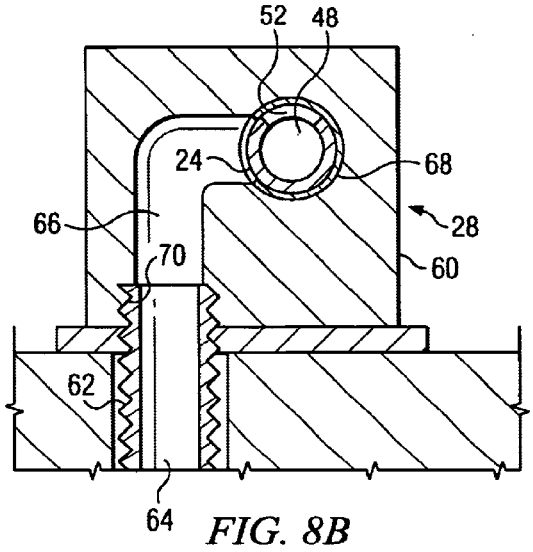
Figure 9A:
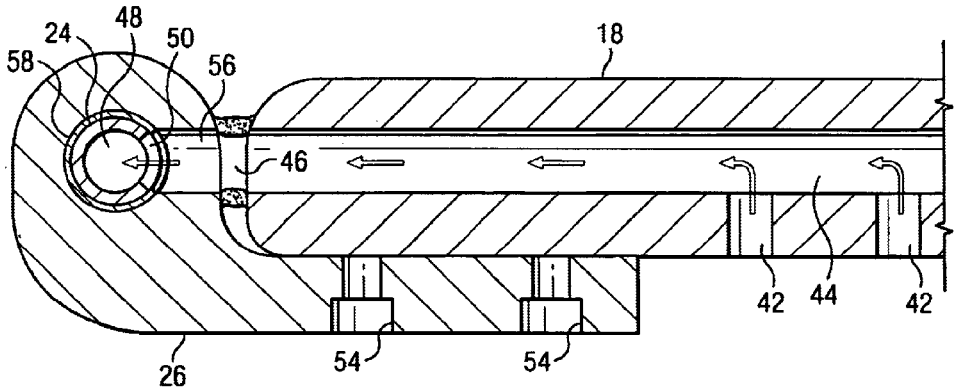
FIG. 9A is a cross-sectional view of the toilet seat hinge and tubular manifold and FIG. 9B is a cross-sectional view of the mounting fixture and tubular manifold when the cover is raised to a vertical position, the seat is in a horizontal position, and air is being ventilated from the toilet bowl.
Figure 9B:
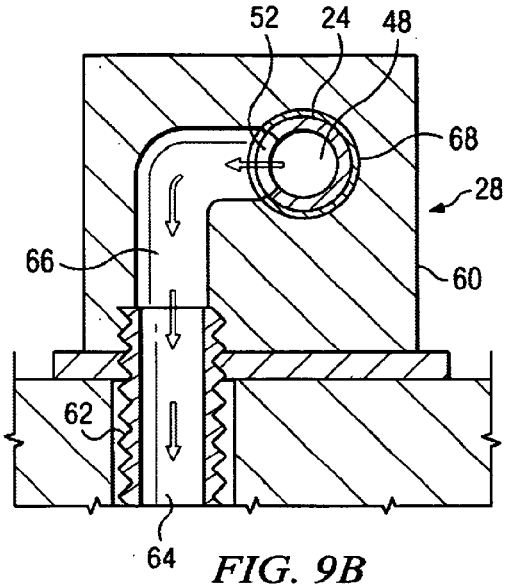

The toilet seat 18 and the cover 20 have three different combinations for positioning the seat 18 and cover 20 on the toilet bowl 12. The seat 18 and cover 20 can both be in the horizontal, lowered position, as shown in FIGS. 8A–8B. The second position is having the seat 18 in the horizontal position and the cover 20 in the vertical position, as shown in FIGS. 9A–9B. The third position is when the seat 18 and cover 20 are both in the vertical, raised position, as shown in 10A–10B.

FIG. 8A shows the position of the inlet 50 of manifold 24 in relation to the passageway 56 of the seat hinge 26 when the cover 20 is in the lowered, horizontal position. The inlet 50 and passageway 56 are not aligned and the body of the tubular manifold 24 blocks passageway 56. Consequently, air is not communicated from the seat passageway 44 to the manifold cavity 48. FIG. 8B shows the position of the outlet 52 of manifold 24 in relation to the passageway 66 of the mounting bracket 28. The outlet 52 and the passageway 66 are not aligned and the body of the tubular manifold 24 blocks the passageway 66. Air is not communicated from the manifold cavity 48 to the passageway 66.

When the toilet seat cover 20 is raised and the toilet seat 18 remains in the horizontal position, the manifold is rotated such that the inlet 50 is aligned with passageway 56 and the outlet 52 is aligned with passageway 66 (FIGS. 9A–9B). As shown by the arrows in FIGS. 9A–9B, air is communicated from adjacent the toilet bowl 12 through vent 42 to passageway 44 and discharge aperture 46, through passageway 56 and inlet 50 into the cavity 48 of manifold 24. The air is further communicated through outlet 52 into passageway 66 of the mounting block body 60 and passageway 64 of the mounting bolt 62. The conduit 32, connected to the discharge fixture 76 at the end of the mounting bolt 62, communicates the air to the external vent 36.

Figure 10A:
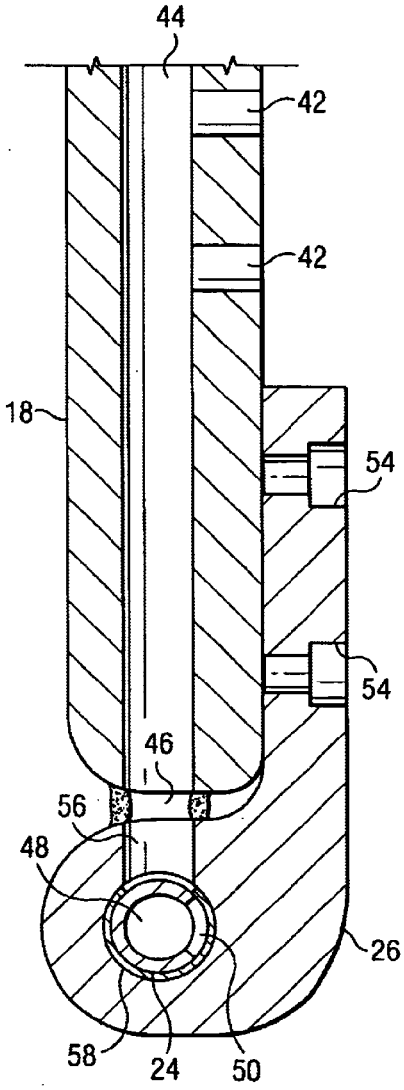
FIG. 10A is a cross-sectional view of the toilet seat hinge and tubular manifold and FIG. 10B is a cross-sectional view of the mounting fixture and tubular manifold when the cover and seat are both in a vertical position and air is not being ventilated from the toilet bowl.
Figure 10B:
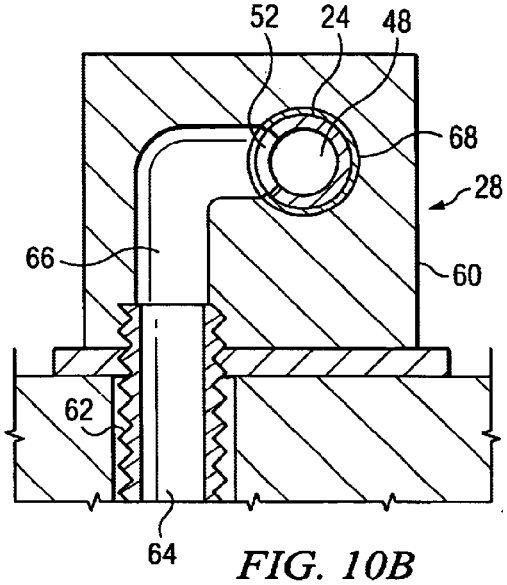

When the toilet seat 18 is raised such that both the seat 18 and cover 20 are in the raised, vertical position, the toilet seat hinge 26 is rotated to a new position on the manifold 24 (FIGS. 10A–10B). In the seat 18 is rotated from the horizontal position in FIGS. 9A–9B (cover 20 raised, seat 18 down) to the raised position in FIGS. 10A–10B (both seat 18 and cover 20 raised), the cover 20 has not been moved, which means that the manifold 24 has not been rotated with the bracket ring 68 of the mounting bracket 28 The outlet 52 of the manifold 24 is aligned with the passageway 66. But when the seat 18 is raised, the seat hinge 26 is rotated about the manifold 24 such that the seat hinge passageway 56 is no longer aligned with the inlet 50. The passageway 56 is covered by the body of manifold 24. Consequently air is not communicated from the seat passageway 44 into the cavity 48 of the manifold 24.

For the three configurations of the toilet seat 18 and toilet seat cover 20 noted above, the air communication from the seat passageway 44 to the conduit 32 is blocked when the seat 18 and cover 20 are both in the lowered, horizontal position and when they are both in the raised, vertical position. An air communication passageway is established when the seat 18 is horizontal and the cover 20 is vertical. Since most of the unwanted odor is created at the toilet bowl 12 when the seat 18 and cover 20 are in such a configuration, the assembly 10 of the present invention provides a cost effective and convenient means for communicating air from the seat passageways 44 to the conduit 32 and the exhaust vent 36.

Figure 11A:
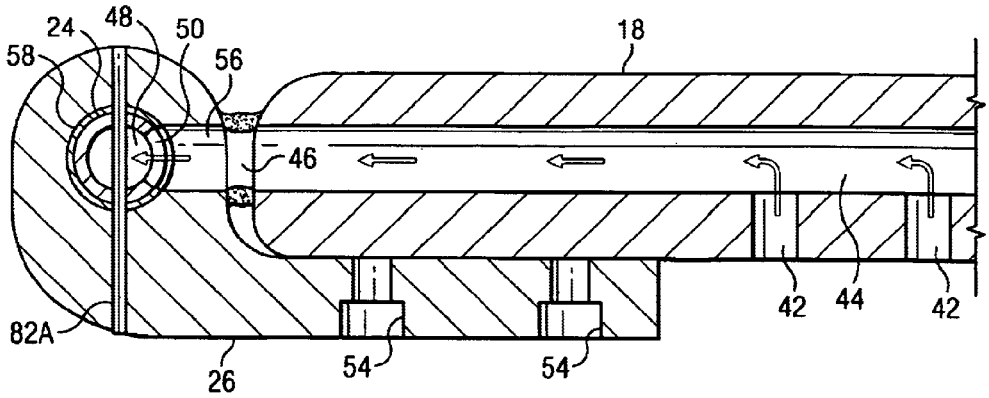
FIG. 11A is a cross-sectional view of the toilet seat hinge and tubular manifold of an alternative embodiment having the toilet seat hinge being fixed to the manifold.
Figure 11B:
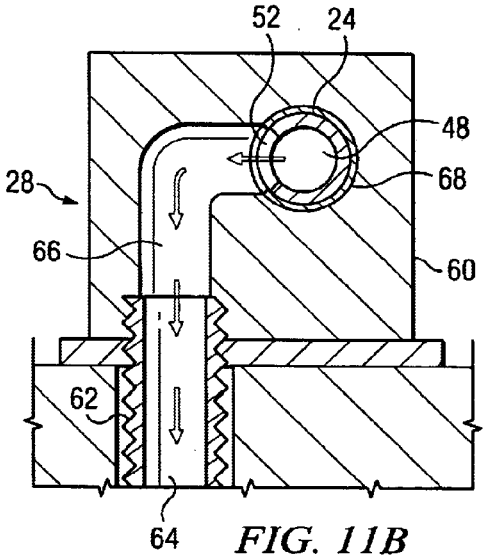
FIG. 11B is a cross-sectional view of the mounting fixture and tubular manifold when the seat is in the horizontal, lowered position so that air is ventilated from the toilet bowl.
Figure 11C:
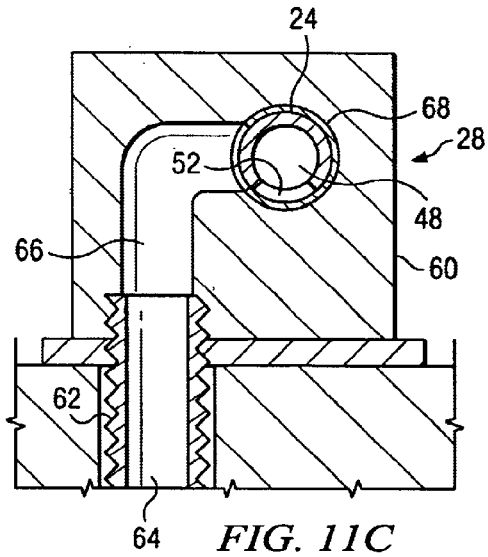
FIG. 11C is a cross-sectional view of the mounting fixture and tubular manifold when the seat is in the vertical, raised position such that the manifold has been rotated to block the ventilation of air from the toilet bowl.

FIGS. 11A, 11B, and 11C show an alternative configuration of the toilet seat assembly in which the seat hinge 26 is connected to the manifold 24 by pin 82A. In public restrooms, most of the toilet bowls only have seats and the covers are not provided,. Securing the seat hinge 26 to the manifold 24 as shown in FIG. 11A facilitates operation of the present invention in such configuration. All of the parts of the assembly are exactly the same except that the seat hinge 26 is affixed to the manifold 24 instead of the cover hinge 30. Pin 82A connects the mounting ring 58 of seat hinge 26 to the manifold 24 such that the inlet 50 to the manifold cavity 48 is aligned with the seat hinge passageway 56. Since the manifold 24 is fixed in the mounting ring 58, the inlet 50 and passageway 56 will always be aligned in both the horizontal and vertical positions. The manifold 24 is still rotatably positioned in the mounting ring 68 of the mounting bracket 28. When the seat 18 is in the horizontal position, the outlet 52 of the manifold cavity 48 is aligned with the bracket passageway 66 (FIG. 11B) to permit communication of air from the toilet seat passageway 44 through the seat hinge passageway 56 to the manifold cavity 48, the bracket passageway 66, the bolt passageway 64, the conduit 32 and the external vent 36. When the seat 18 is raised to the vertical position, the manifold 24 is rotated in the mounting ring 68 of the mounting bracket 28 (FIG. 11C) such that the passageway 66 is not aligned with the outlet 52 of the manifold 24, but the passageway 66 is blocked by the body of the manifold 24. Although a seat cover is not necessary in this configuration, a seat cover can be included. The same cover 20 and cover hinge 30 with mounting ring 78 can be used. Instead of being affixed to the manifold 24, the mounting ring 78 of hinge 30 would be rotatably connected the manifold 24. The cover 39 could be selectively, independently rotated on the manifold 24 between the horizontal position and the vertical position, and would have no effect on the operation of the assembly.

The manifold 24 is shown in FIG. 4 having two inlets 50 and two outlets 52, one at each end of the manifold 24. However, the assembly 10 could function to remove air from the toilet bowl 12 having only one inlet 50 and one outlet 52. The one inlet 50 and one outlet 52 could be on the same end of the manifold 24, or even on opposite ends of the manifold 24, and an air communication passageway would still be established from the seat passageway 44 to the conduit 32. If only one inlet 50 and one outlet 52 were used, the seat passageway 44 would be directed to a single discharge aperture 46, and only one of the mounting brackets would be provided with a passageway 66 and hollow mounting bolt 62. In the assembly 10 of the present invention, the only component positioned along the back edge of the toilet seat 18 between the mounting bracket 28 and hinges 26, 30 is a slender, tubular manifold 24. The manifold 24 does not rest on the top surface 16 of the toilet bowl 12. Because the manifold 24 is spaced apart from the top surface 16 of the toilet bowl 12, the assembly 10 is easier to keep clean. In addition, water or urine have less of a chance to gain access to the manifold cavity 48.

Because of the contour of the back edge of many toilet seat designs, possible leakage about the seat discharge aperture 46 and the passageway 56 of seat hinge 26 may be a concern. The junction of the discharge aperture 46 and passageway 56 could be sealed with any type of sealing compound 47. Alternatively, a tubular extension (not shown) could be included when the hinge 26 is molded such that the tubular extension is fitted in the discharge aperture 46 to prevent leakage.

Figure 12:
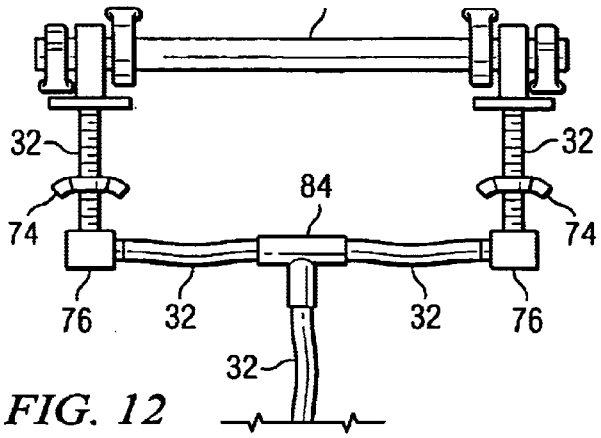
FIG. 12 is a rear view of the toilet seat ventilation assembly showing exhaust conduit connected to both of the mounting fixtures.
Figure 13:
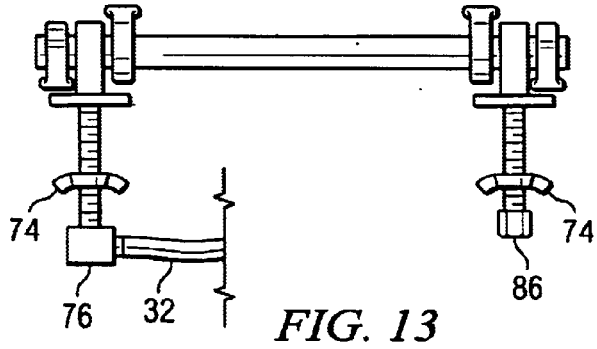
FIG. 13 is a rear view of the mounting fixture showing the externally thread bolt extending from the mounting fixture and a cap secured to the open end of the bolt such that air is ventilated from only one mounting fixture.

Air communication from the toilet ventilation assembly 10 can be provided by either a single conduit 32 or two conduits 32 (FIGS. 12–13). When two conduits 32 are used with a conduit extending from each of the discharge fixtures 76 of mounting bolts 32, a T-port 84 or other similar junction fixture may be used to combine the two conduits into a single conduit. The T-port 84 can be positioned at any convenient place in proximity to the toilet bowl 12 or the wall adjacent the toilet bowl 12. In an assembly 10 furnished with two outlets 52 and two corresponding mounting brackets 28, the eventual installer or user may want to use only one conduit for appearance purposes or because of conduit mounting difficulties. In such a case, a threaded cap 86 may be placed on the open end of the externally threaded, hollow mounting bolt. If the assembly is manufactured as a kit for subsequent installation, the manufacturer does not have to designate whether ventilation will occur from the left mounting bracket, the right mounting bracket, or both. Including a T-port 84 and a cap 86 with a standard two outlet, two mounting port kit will allow the installer to easily choose the desired configuration.

The distance between the two toilet bowl mounting apertures appears to be a standard 5 inch distance. Consequently, one length of manifold can be use for all toilet bowls with standard aperture spacing. For non-standard toilet bowls, the only modification for mounting the system on the toilet bowl would be to change the length of the manifold 24 such that the inlets 50 and outlets 52 are formed within approximately a one inch outer segment of the manifold 24. The diameter of the manifold 24 can also vary. Typically, a quarter inch diameter is large enough to provide sufficient capacity for removing the odors.

The conduit 32 extending from the discharge fixture 76 on bolt 62 of the mounting bracket 26 is generally a flexible tubing which can be directed from the fixture 76 to a wall port 88 for communication through a wall or ceiling in proximity to the toilet bowl 12. A number of different types of exhaust system conduit are known for use in transporting exhaust air from the wall port 88 to the exhaust vent 36. The conduit 32A positioned behind the wall can be a rigid pipe or a flexible conduit. If the toilet bowl 12 is in a room with an outside wall, the conduit 32 can be directed directly to an exhaust vent on the outside wall.

Figure 14:
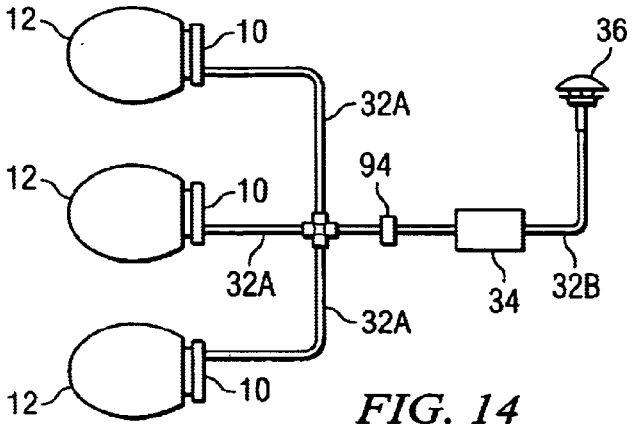
FIG. 14 is a schematic view showing a plurality of toilet seat ventilation assemblies and the corresponding exhaust vacuum conduits in communication with an external vent through a single ventilation fan motor.

The toilet ventilation system of the present invention also includes a means for drawing air from adjacent the toilet bowl 12. A number of air moving means are well known and they may be arranged in a variety of configurations. In one embodiment, the air moving means comprises a fan 34 or similar air-flow inducing device associated with the conduit 32A. The fan 34 may be located in a number of areas and may be a variety of types and sizes depending on the installation. The size of the fan 34 will depend on the length of the conduit 32A and the number of ventilation systems being vented by the fan 34. In a residence or commercial application with more than one toilet bowl 12 being vented, the most economical method would be to connect conduit 32A to a main exhaust conduit 32B and utilizing a single fan motor 34 and exhaust vent 36 for multiple assemblies (FIG. 14).

The fan motor 34 or other similar air movement means can be controlled in a number of different ways. An on-off wall switch 90 similar to the switch used for bathroom ceiling fans, could be mounted in the wall by existing light and fan switches, or in a separate electrical fixture in closer proximity to the toilet bowl 12. Alternatively, a pressure sensitive switch 92 or similar contact switch could be positioned on the toilet seat 18 so that the fan motor 34 would be activated when a person is sitting on the scat 18. The pressure switch 92 could be mounted underneath the seat 18 on or in proximity to one of the spacers 22. The necessary electrical connection to power and control the fan motor 34 via the wall switch 90 or via the pressure switch 92 are well known. The control wires from the pressure switch 92 could be secured from the seat 18 along the conduit 32 to the wall port 88. Another method for controlling the fan motor 34 would be an electrical eye properly installed such that the fan motor is automatically started when a user is in position to use the seat 18 on the toilet bowl 12.

Another control device which may prevent the accidental overload of the fan motor 34 is a pressure relief valve. In a system with multiple assemblies 10, if the fan motor 34 is left on and all of the assemblies are closed off such that no air is being communicated from the toilet bowls, the vacuum pressure may build up in the conduit 32A such that the motor 34 may be overheated by the total blockage. To prevent such an overload, a vacuum relief valve 94 or other vacuum pressure relief mechanism may be installed in the conduit 32A in proximity to the fan motor 34.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

What is claimed is:

1. A toilet seat ventilation assembly for mounting on a toilet bowl, said toilet seat ventilation assembly secured to the toilet bowl at the two mounting holes at the back upper surface of the toilet bowl, and connected to an exhaust system for removing odors from around the toilet bowl, said toilet bowl ventilation assembly comprising:

a toilet seat having a plurality of vent holes formed in a bottom surface of said toilet seat and an internal passageway connecting said vent holes to a discharge aperture at a back edge of said toilet seat;

a tubular manifold positioned along the back edge of said toilet seat, said tubular manifold including an inlet aperture and an outlet aperture formed in a side surface of said manifold adjacent an end of the manifold;

a first seat hinge and a second seat hinge rotatably mounted on opposite ends of said tubular manifold and connected to the back edge of said toilet seat to facilitate the selective movement of the toilet seat between a horizontal position engaging the toilet bowl and a vertical position, the first seat hinge being positioned adjacent the discharge aperture, and having a passageway formed in said hinge for selectively connecting the discharge aperture of said toilet seat to the inlet aperture of said manifold;

a first mounting fixture and a second mounting fixture for rotatably securing the tubular manifold, said mounting fixtures positioned at opposite ends of the manifold adjacent said seat hinges, and positioned on the toilet seat at the mounting holes for securing said tubular manifold and the toilet seat to the toilet bowl, each of said mounting fixtures having an externally threaded bolt extending down from a body of the mounting fixture through the mounting holes and having a nut to secure the mounting fixtures on the toilet bowl, and the first mounting fixture being positioned about the outlet aperture of said manifold and having a passageway extending from the manifold through the body of said first mounting fixture and through the length of the externally threaded bolt; and a toilet seat cover having a pair of hinges extending from a back edge of said toilet seat cover and connected to said manifold, said toilet seat cover rotating said tubular manifold when the toilet seat cover is selectively moved between a horizontal position adjacent the toilet seat and a vertical position, whereby, when the toilet seat cover is in the vertical position and the toilet seat is in the horizontal position, the passageway in the first seat hinge is aligned with the inlet aperture and the passageway of the first mounting fixture is aligned with the outlet aperture of the tubular manifold, and an air communication passage is established from the vent holes through the internal passageway of the toilet seat through the discharge aperture through the seat hinge through the manifold through the mounting fixture and the externally threaded bolt to the exhaust system, and whereby when the toilet seat and toilet seat cover are both in the vertical position or both in the horizontal position, the passageway of the first seat hinge is not aligned with the inlet aperture of said manifold such that the air communication passage is blocked.

2. The toilet seat ventilation assembly defined in claim 1, wherein said toilet seat includes a second discharge aperture spaced apart from the first discharge aperture, and said tubular manifold includes a second inlet at the opposite end of the manifold from the first inlet, and the second seat hinge is positioned adjacent the second discharge aperture and includes a passageway formed in said second hinge for selectively connecting the second discharge aperture of said toilet seat to the second inlet aperture of said manifold.

3. The toilet seat ventilation assembly defined in claim 1, wherein said tubular manifold includes a second outlet at the opposite end of the manifold from the first outlet, and the second mounting fixture being positioned about the second outlet aperture of said manifold and having a passageway extending from the manifold through the body of said second mounting fixture and through the length of the externally threaded bolt, wherein both the first mounting fixture and the second mounting fixture are connected to the exhaust system.

4. The toilet seat ventilation assembly defined in claim 1, wherein said toilet seat includes a second discharge aperture spaced apart from the first discharge aperture, and said tubular manifold includes a second inlet at the opposite end of the manifold from the first inlet, and the second seat hinge is positioned adjacent the second discharge aperture and includes a passageway formed in said second hinge for selectively connecting the second discharge aperture of said toilet seat to the second inlet aperture of said manifold, and said tubular manifold includes a second outlet at the opposite end of the manifold from the first outlet, and the second mounting fixture being positioned about the second outlet aperture of said manifold and having a passageway extending from the manifold through the body of said second mounting fixture and through the length of the externally threaded bolt, wherein both the first mounting fixture and the second mounting fixture are connected to the exhaust system.

5. The toilet seat ventilation system defined in claim 4, including a cap attached to an open end of the externally threaded bolt of the second mounting fixture with only the externally threaded bolt of the first mounting system being connected to the exhaust system.

6. A toilet seat ventilation system for mounting on a toilet bowl having two mounting holes at the back upper surface of the toilet bowl, and for removing odors from around the toilet bowl, said toilet bowl ventilation system comprising:

a toilet seat having a plurality of vent holes formed in a bottom surface of said toilet seat and an internal passageway connecting said vent holes to a discharge aperture at a back edge of said toilet seat;

a tubular manifold positioned along the back edge of said toilet seat, said tubular manifold including an inlet aperture and an outlet aperture formed in a side surface of said manifold adjacent an end of the manifold, said inlet and outlet apertures being off-set and spaced apart;

a first seat hinge and a second seat hinge rotatably mounted on opposite ends of said tubular manifold and connected to the back edge of said toilet seat to facilitate the selective movement of the toilet seat between a horizontal position engaging the toilet bowl and a vertical position, the first seat hinge being positioned adjacent the discharge aperture, and having a passageway formed in said hinge for selectively connecting the discharge aperture of said toilet seat to the inlet aperture of said manifold;

a first mounting fixture and a second mounting fixture for rotatably securing the tubular manifold, said mounting fixtures positioned at opposite ends of the manifold adjacent said seat hinges, and positioned on the toilet seat at the mounting holes for securing said tubular manifold and the toilet seat to the toilet bowl, each of said mounting fixtures having an externally threaded bolt extending down from a body of the mounting fixture through the mounting holes and having a nut to secure the mounting fixtures on the toilet bowl, and the first mounting fixture being positioned about the outlet aperture of said manifold and having a passageway extending from the manifold through the body of said first mounting fixture and through the length of the externally threaded bolt;

a toilet seat cover having a pair of hinges extending from a back edge of said toilet seat cover and connected to said manifold, said toilet seat cover rotating said tubular manifold when the toilet seat cover is selectively moved between a horizontal position adjacent the toilet seat and a vertical position, whereby, when the toilet seat cover is in the vertical position and the toilet seat is in the horizontal position, the passageway in the first seat hinge is aligned with the inlet aperture and the passageway of the first mounting fixture is aligned with the outlet aperture of the tubular manifold, and an air communication passage is established from the vent holes through the internal passageway of the toilet seat through the discharge aperture through the seat hinge through the manifold through the mounting fixture and the externally threaded bolt, and whereby when the toilet seat and toilet seat cover are both in the vertical position or both in the horizontal position, the passageway of the first seat hinge is not aligned with the inlet aperture of said manifold such that the air communication passage is blocked;

an exhaust conduit connected to an open end of the externally threaded bolt extending from the first mounting fixture, said exhaust conduit extending the air communication passage to the exhaust point; and an air moving exhaust means connected to said conduit for drawing air from an area adjacent the toilet bowl through the air communication passage and the exhaust conduit to the exhaust point.

7. The toilet seat ventilation system defined in claim 6, wherein said toilet seat includes a second discharge aperture spaced apart from the first discharge aperture, and said tubular manifold includes a second inlet at the opposite end of the manifold from the first inlet, and the second seat hinge is positioned adjacent the second discharge aperture and includes a passageway formed in said second hinge for selectively connecting the second discharge aperture of said toilet seat to the second inlet aperture of said manifold.

8. The toilet seat ventilation system defined in claim 6, wherein said tubular manifold includes a second outlet at the opposite end of the manifold from the first outlet, and the second mounting fixture being positioned about the second outlet aperture of said manifold and having a passageway extending from the manifold through the body of said second mounting fixture and through the length of the externally threaded bolt, wherein the externally threaded bolt of the first mounting fixture is connected to a first feeder conduit and the externally threaded bolt of the second mounting fixture is connected to a second feeder conduit, and the first feeder conduit and the second feeder conduit merge into the exhaust conduit.

9. The toilet seat ventilation system defined in claim 6, wherein said toilet seat includes a second discharge aperture spaced apart from the first discharge aperture, and said tubular manifold includes a second inlet at the opposite end of the manifold from the first inlet, and the second seat hinge is positioned adjacent the second discharge aperture and includes a passageway formed in said second hinge for selectively connecting the second discharge aperture of said toilet seat to the second inlet aperture of said manifold, and said tubular manifold includes a second outlet at the opposite end of the manifold from the first outlet, and the second mounting fixture being positioned about the second outlet aperture of said manifold and having a passageway extending from the manifold through the body of said second mounting fixture and through the length of the externally threaded bolt, wherein the externally threaded bolt of the first mounting fixture is connected to a first feeder conduit and the externally threaded bolt of the second mounting fixture is connected to a second feeder conduit, and the first feeder conduit and the second feeder conduit merge into the exhaust conduit.

10. The toilet seat ventilation system defined in claim 9, including a cap attached to an open end of the externally threaded bolt of the second mounting fixture to replace the second feeder conduit, such that only the externally threaded bolt of the first mounting system is connected to the exhaust conduit.

11. The toilet seat ventilation system defined in claim 6, including a wall mounted on-off switch mounted in proximity to the toilet bowl for turning the air moving exhaust means on and off.

12. The toilet seat ventilation system defined in claim 6, including a pressure activated switch positioned between the upper surface of the toilet bowl and a bottom surface of the toilet seat such that the air moving exhaust means will be turned on when the toilet seat is occupied by a user and the air moving exhaust means is turned off when the toilet seat is not occupied.

13. The toilet seat ventilation system defined in claim 6, including a pressure relief means connected to said exhaust conduit in proximity to the air moving exhaust means.

14. A toilet seat ventilation system for mounting on a plurality of toilet bowls, each toilet bowl having two mounting holes at the back upper surface of the toilet bowl, and for removing odors from around the toilet bowls, said toilet bowl ventilation system comprising:

a plurality of toilet bowl ventilation assemblies for mounting on a plurality of toilet bowls, each a toilet bowl ventilation assembly comprising:

a toilet seat having a plurality of vent holes formed in a bottom surface of said toilet seat and an internal passageway connecting said vent holes to a discharge aperture at a back edge of said toilet seat;

a tubular manifold positioned along the back edge of said toilet seat, said tubular manifold including an inlet aperture and an outlet aperture formed in a side surface of said manifold adjacent an end of the manifold, said inlet and outlet apertures being off-set and spaced apart;

a first seat hinge and a second seat hinge rotatably mounted on opposite ends of said tubular manifold and connected to the back edge of said toilet seat to facilitate the selective movement of the toilet seat between a horizontal position engaging the toilet bowl and a vertical position, the first seat hinge being positioned adjacent the discharge aperture, and having a passageway formed in said hinge for selectively connecting the discharge aperture of said toilet seat to the inlet aperture of said manifold;

a first mounting fixture and a second mounting fixture for rotatably securing the tubular manifold, said mounting fixtures positioned at opposite ends of the manifold adjacent said seat hinges, and positioned on the toilet seat at the mounting holes for securing said tubular manifold and the toilet seat to the toilet bowl, each of said mounting fixtures having an externally threaded bolt extending down from a body of the mounting fixture through the mounting holes and having a nut to secure the mounting fixtures on the toilet bowl, and the first mounting fixture being positioned about the outlet aperture of said manifold and having a passageway extending from the manifold through the body of said first mounting fixture and through the length of the externally threaded bolt;

a toilet seat cover having a pair of hinges extending from a back edge of said toilet seat cover and connected to said manifold, said toilet seat cover rotating said tubular manifold when the toilet seat cover is selectively moved between a horizontal position adjacent the toilet seat and a vertical position, whereby, when the toilet seat cover is in the vertical position and the toilet seat is in the horizontal position, the passageway in the first seat hinge is aligned with the inlet aperture and the passageway of the first mounting fixture is aligned with the outlet aperture of the tubular manifold, and an air communication passage is established from the vent holes through the internal passageway of the toilet seat through the discharge aperture through the seat hinge through the manifold through the mounting fixture and the externally threaded bolt, and whereby when the toilet seat and toilet seat cover are both in the vertical position or both in the horizontal position, the passageway of the first seat hinge is not aligned with the inlet aperture of said manifold such that the air communication passage is blocked;

a plurality of exhaust feeder conduits corresponding to the plurality of toilet bowl ventilation assemblies, each assembly having an exhaust feeder conduit connected to an open end of the externally threaded bolt extending from the first mounting fixture, and a main exhaust conduit with means for merging all of the exhaust feeder conduits, said exhaust feeder conduits and main exhaust conduit extending the air communication passages to an exhaust point; and an air moving exhaust means connected to said main exhaust conduit for drawing air from an area adjacent the toilet bowls through the air communication passages, the feeder exhaust conduits, and the main exhaust conduit to the exhaust point.

15. The toilet seat ventilation system defined in claim 14, wherein said toilet seat includes a second discharge aperture spaced apart from the first discharge aperture, and said tubular manifold includes a second inlet at the opposite end of the manifold from the first inlet, and the second seat hinge is positioned adjacent the second discharge aperture and includes a passageway formed in said second hinge for selectively connecting the second discharge aperture of said toilet seat to the second inlet aperture of said manifold, and said tubular manifold includes a second outlet at the opposite end of the manifold from the first outlet, and the second mounting fixture being positioned about the second outlet aperture of said manifold and having a passageway extending from the manifold through the body of said second mounting fixture and through the length of the externally threaded bolt, wherein the externally threaded bolt of the first mounting fixture is connected to a first feeder conduit and the externally threaded bolt of the second mounting fixture is connected to a second feeder conduit, and the first feeder conduit and the second feeder conduit merge into the exhaust conduit.

16. The toilet seat ventilation system defined in claim 15, including a cap attached to an open end of the externally threaded bolt of the second mounting fixture to replace the second feeder conduit, such that only the externally threaded bolt of the first mounting system is connected to the exhaust conduit.

* * * * *